US005284331A

United States Patent [19]

Lee et al.

[11] Patent Number: 5,284,331

[45] Date of Patent: Feb. 8, 1994

[54] WOODWORKING BENCH SYSTEM

[75] Inventors: Leonard G. Lee; John S. Lynn, both of Ottawa; Francis A. McLean, Oxford Station; Edwin C. Tucker, Ottawa; Lloyd Sevack, Nepean; Gary W. Lacoste, Almonte; Timothy C. Frank, Ottawa; Michel Perrier, Orleans; Michael T. O'Malley, Carp, all of Canada

[73] Assignee: Lee Valley Tools Ltd., Ottawa, Canada

[21] Appl. No.: 961,489

[22] Filed: Oct. 15, 1992

Related U.S. Application Data

[63] Continuation-in-part of Ser. No. 816,924, Jan. 3, 1992, Pat. No. D. 339,728, and a continuation-in-part of Ser. No. 927,327, Aug. 10, 1992, and a continuation-in-part of Ser. No. 927,326, Aug. 10, 1992.

[51] Int. Cl.[5] ..... B25B 1/00

[52] U.S. Cl. ..... 269/16; 269/88; 269/91; 269/139; 269/155; 269/222; 269/900

[58] Field of Search ..... 144/286 A, 286, 287; 269/900, 901, 139, 155, 152, 283, 258, 88, 91-94, 295, 222, 221, 15, 16

[56] References Cited

U.S. PATENT DOCUMENTS 3,212 8/1843 Matthews .
27,592 3/1860 Cooper .
(List continued on next page.)

FOREIGN PATENT DOCUMENTS 241243 5/1959 Australia .
505411 9/1951 Belgium .
278666 11/1913 Fed. Rep. of Germany .
2484317 12/1981 France ..... 144/286 A
524066 4/1955 Italy .
379885 7/1964 Switzerland .

OTHER PUBLICATIONS

Record Bench Holdfast depicted on p. 93 of the Lee Valley Tools 1991/92 Catalog.
Bench Hold-Down depicted on p. 93 of the Lee Valley Tools 1991/92 Catalog.
Classic Hold-Down depicted on p. 93 of the Lee Valley Tools 1991/92 Catalog.
"C clamp" hold-down depicted in 1992 Wolfcraft work tables brochure.
Landis, Scott, The Workbench Book, The Taunton Press Inc., p. 133, 1987.
Thonet, Michael, Fine Woodworking, Jan./Feb. 1980, No. 20, pp. 70-71.

*Primary Examiner*—Robert C. Watson
*Attorney, Agent, or Firm*—Kilpatrick & Cody

[57] ABSTRACT

A woodworking bench and related fixtures providing an integrated system of bench features, vises, dogs, panel clamps, hold-downs and fixtures that cooperate to provide a highly flexible workpiece holding and clamping apparatus able to accommodate a wide variety of shapes and sizes of workpieces and hold such workpieces in an enormous variety of positions during numerous different operations. Two substantial slabs provide the bench top surface and carry a rectilinear pattern (in rows and files) of round, vertical bench dog holes. The rectilinear pattern of round bench dog holes with specific, equal spacing between holes, and similar holes in the edge of the top, facilitate great flexibility in clamping using conventional round dogs in the bench top holes and corresponding dogs in bench edge-mounted, or end-mounted vises. Such holes also accommodate other clamping, fixing and hold-down fixtures that contribute to flexibility and utility. The two slabs are separated by a tool trough, and optional bench top ends or caps span the ends of the slabs, unify the bench top structure and provide a fixed jaw for an end-mounted twin screw vise. Optional skirts form a deep longitudinal edge for the top and join the ends to form a rectangular frame for the top. Dog holes in the edge of the top permit workpieces to be fixed along the bench edge using the hold-down, two clamping bench dogs, or a fixed dog and either of the clamping dog or the twin screw vise.

31 Claims, 6 Drawing Sheets

U.S. PATENT DOCUMENTS

| | | | |
|---|---|---|---|
| 162,866 | 5/1975 | Squire . | |
| 201,407 | 3/1978 | Gordon . | |
| 293,058 | 2/1884 | Moore . | |
| 326,138 | 9/1885 | Moore . | |
| 467,781 | 1/1892 | Palm et al. . | |
| 515,986 | 3/1894 | Barnard . | |
| 663,145 | 12/1990 | Zwart . | |
| 816,508 | 3/1906 | Snow . | |
| 985,857 | 3/1911 | Thomas . | |
| 1,392,434 | 10/1921 | Miller . | |
| 2,308,996 | 1/1943 | Millen | 269/221 |
| 2,877,815 | 3/1959 | Fonken . | |
| 2,883,184 | 4/1959 | Brewington | 269/91 |
| 2,994,236 | 8/1961 | McCormick . | |
| 3,208,744 | 9/1965 | Slifer . | |
| 3,380,730 | 4/1968 | Carver . | |
| 3,850,421 | 11/1974 | Orris . | |
| 3,993,298 | 11/1976 | Marshall . | |
| 4,084,803 | 4/1978 | Beekenkamp | 269/91 |
| 4,265,435 | 5/1981 | Stiltz et al. | 269/139 |
| 4,291,869 | 9/1981 | Hickman | 269/139 |
| 4,470,586 | 9/1984 | Spencer . | |
| 4,625,951 | 12/1986 | Yang | 269/900 |
| 4,644,833 | 2/1987 | Jenkner | 269/295 |
| 4,858,902 | 8/1989 | Hickman . | |
| 4,953,839 | 9/1990 | Chern . | |
| 5,048,653 | 9/1991 | Fellows . | |

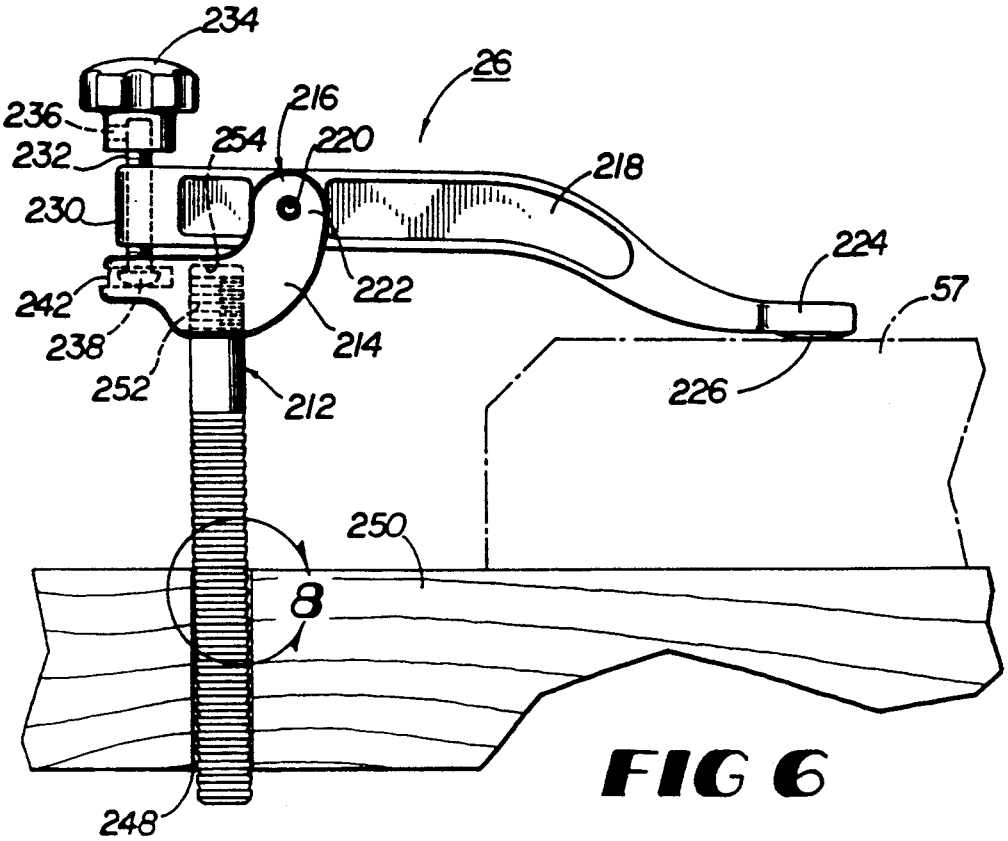
FIG 6
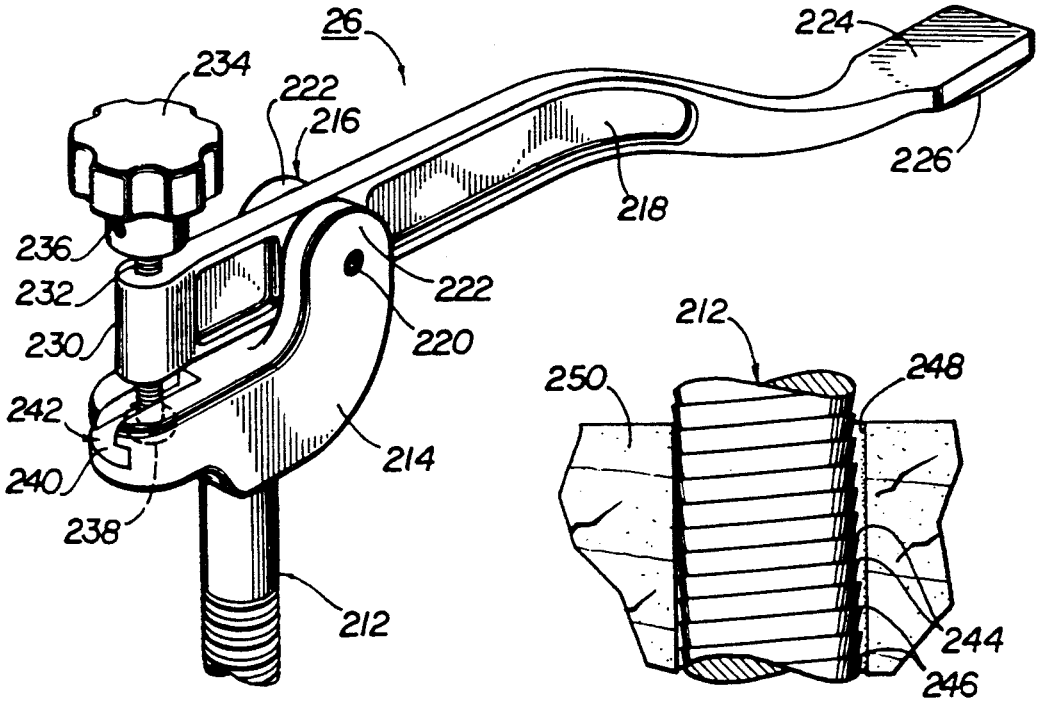
FIG 7
FIG 8

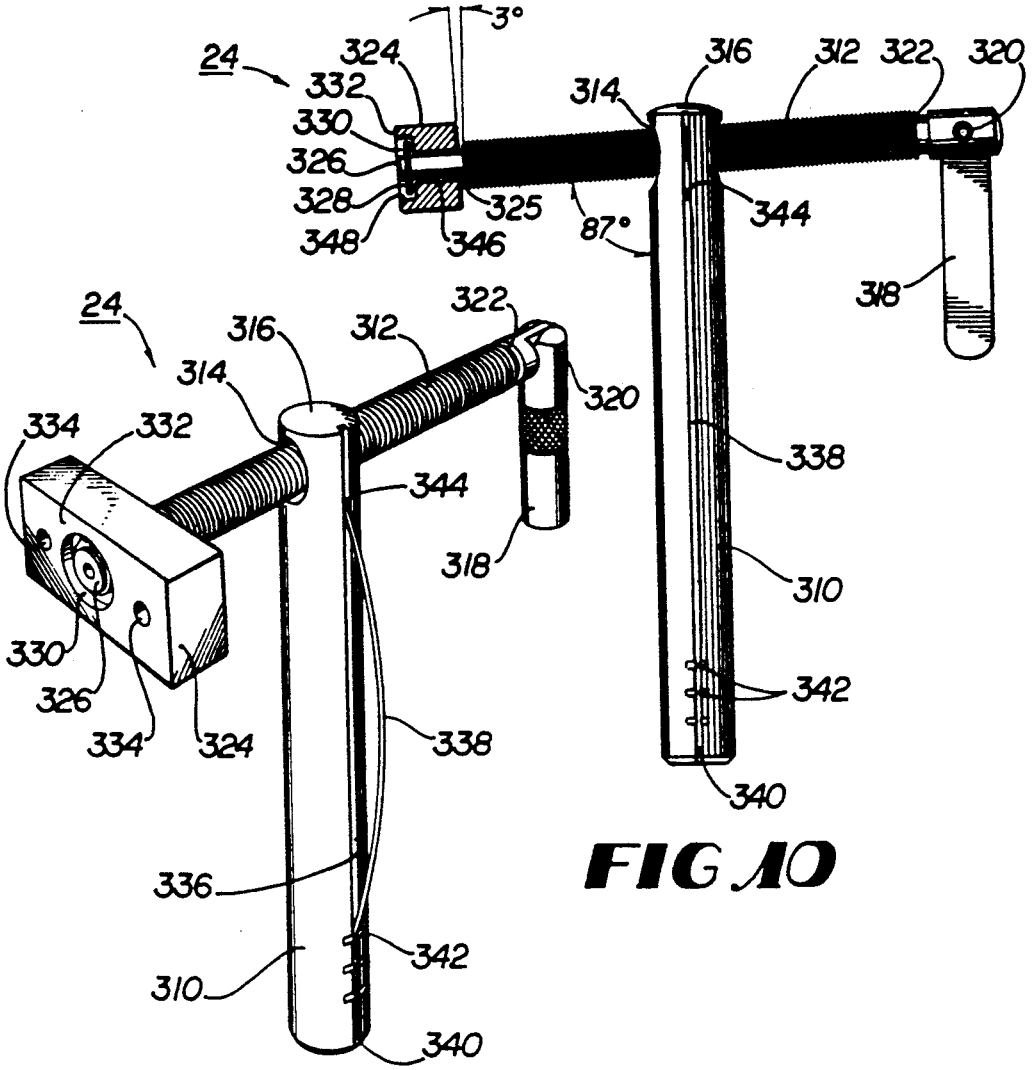
FIG 10
FIG 9
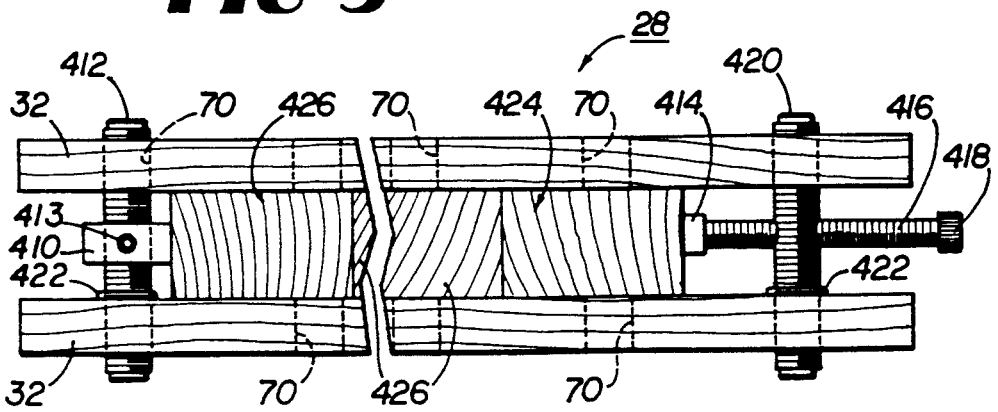
FIG 11

WOODWORKING BENCH SYSTEM

CROSS-REFERENCE TO RELATED APPLICATIONS

This application is a continuation-in-part of patent application Ser. Nos.:

(1) 07/816,924 filed Jan. 3, 1992, now U.S. Pat. No. D339,728 for an "Adjustable Bench Clamp;"

(2) 07/927,327 filed Aug. 10, 1992, for a "Bench Hold-Down;" and (3) 07/927,326 filed Aug. 10, 1992, for a "Twin Screw Vise,"

each of which applications is incorporated herein by this reference.

BACKGROUND OF THE INVENTION

This invention relates to woodworking benches and associated devices for holding workpieces.

Workbenches, Bench Dogs and Vises

One of the oldest needs in the field of woodworking is the need to hold a workpiece. Solutions have been developed in great variety throughout the world, although it can be argued that eastern and western woodworking have followed different paths. Eastern woodworking typically uses somewhat simpler devices for holding workpieces, and the woodworker's feet are often directly involved. Western woodworkers typically work standing and have, by contrast, evolved the extensive use of benches on which workpieces are rested and to which they are frequently affixed. Wall illustrations in the Egyptian tomb of Nebanon circa 1450 B.C. depict workbenches, but modern western workbenches have more recent origins documented in German engineering drawings approximately 500 years old. Those drawings show the use of screw-operated tail (or end) and front vises used in conjunction with movable bench dogs to provide a flexible clamping system.

Many of the workbenches well known in the art utilize a substantial top, normally wooden, and one or more bench dogs are often used. Such dogs are typically square or rectangular cross section, wood or metal pins that slide into like-shaped holes located at various positions in the bench top so that the dog can be moved to a desired position. Dogs so positioned in the bench top normally are used to capture a workpiece between the dog and a second dog carried in the movable jaw of a vise mounted at the work bench edge. Traditionally, dogs having square or rectangular cross-sections have been used in dog holes that tilt a few degrees toward the workpiece. More recently round dogs with a face inclined approximately two degrees (2°) relative to their major axis have begun being used in dog holes bored normal to the bench surface.

The need to utilize a woodworking vise in work holding approaches utilizing dogs limits the flexibility of the work holding system and requires the use of a relatively large and expensive vise. The vise is also normally fixed in a particular location on a bench, and this limits the user's ability to orient workpieces on a bench top in positions that do not correspond to the existing vise location.

In part as a result of these limitations, various auxiliary devices have also been developed for holding workpieces, including such devices as hold-downs intended for attachment to a workbench. Additionally, substantial effort has been devoted to the development of devices for clamping workpieces during gluing operations, such as edge-to-edge clamping of boards being glued into panels.

Hold-Downs

Perhaps the oldest known auxiliary device for holding workpieces is the type sometimes known as a "classic" hold-down, consisting of a single-piece metal apparatus having a straight post and a gooseneck that extends out and down from the post to terminate in a foot that presses against the workpiece. The post is inserted in a hole in the workbench top and tapped so that the post cocks within the hole in the top as the gooseneck is flexed to apply pressure on the workpiece. The principal disadvantage associated with this type of hold-down is the difficulty of controlling it. It is very difficult to obtain controlled clamping pressure because such a fixture must be manipulated with a hammer. Additionally, use of such a hold-down over time enlarges the hole in the bench at the top and bottom because of repeated impact and wear of the post against the bench hole into which it fits.

A second type of bench hold-down or "holdfast" has a post that is received in a collar that must be permanently mortised and fixed into the workbench top. Ribs cast into the inside of the collar mate with ribs cast on one side of the post in order to prevent its withdrawal from the collar during use. A hold-down arm terminating in a pivotable foot is itself pivotably mounted on a projection from the top of the post and may be adjustably pressed against a workpiece by the action of a handscrew journaled through the end of the arm opposite the foot so that the screw bears against the top of the post causing the arm to pivot down as the screw is advanced. This type of hold-down permits more easily adjusted clamping pressure than the classic hold-down but can be used only where the required mating collar has been mounted in a workbench.

A third type of hold-down is similar in appearance to one-half of a conventional cast iron C-clamp, including the clamping screw but with a body that terminates in a foot that rests against a workbench top and is held in place by a bolt mounted in the bench top. The clamping capacity of this type of hold-down is limited by the length of the clamping screw and height of the clamping body and typically approximates only three to four inches. Additionally, clamping pressure can be applied only to a portion of a workpiece close to its edge because the reach of this type of hold-down is very limited. Like the pivoting hold-down described above, the clamping type of hold-down can be used only in positions where the securing fixture or bolt have been located in a workbench.

A fourth type of hold-down, somewhat similar to the clamp-type described above, substitutes a smooth round post for a portion of the clamp body, which post is received in a hole in the workbench top. Because the post is smooth, it is held in place solely by the limited friction between the post and the sides of a hole in the bench top, and the post must tilt in order to do so. As a consequence, however, it works well only with relatively thin bench tops that have hole diameters adequate to permit the desired tilt. Such hold downs will not work at all, however, if the hole is too large because the post will simply slip within the hole. Additionally, because the arm in this type of hold-down is rigidly fixed to the post, advancing the screw that applies force against the workpiece through a pad or foot on the end of the screw tends to cause the substantial friction between the foot and the workpiece to resist further canting of the post in the workbench top hole. This can cause the post to slip in the workbench.

Twin Screw Vises

It is frequently desirable for woodworking bench vises to be of substantial width, but it is difficult to obtain a satisfactory vise width greater than approximately twelve inches utilizing a single vise screw, even when multiple guide rods are employed. Accordingly, twin screws have been used in vises of substantially greater width and to realize other benefits. One such benefit is the possibility of skewing the vise jaws relative to each other. While the ability to skew the vise jaws relative to each other (or to skew a movable jaw relative to the bench edge against which it closes) that is inherent in the use of two vise screws is often desirable, it is more frequently desirable that the two screws rotate in synchronism so that the front jaw will move in and out parallel to the rear one or, if a skewed position is needed, the relative skew will remain constant. Previous twin screw vises have achieved synchronized rotation by coupling the two screws with a chain, belt or similar means. Among other drawbacks, such twin screw vises have often been inconvenient to use and difficult to "recalibrate" after operating in a skewed configuration.

Panel Clamps

Numerous panel clamps, exist for clamping boards edge to edge in joining panels, including, among others, sash, bar and pipe clamps. Many of such existing clamps are excellent devices, but most are quite expensive and limited in the panel width they can accommodate.

Despite the long history of efforts in the field of holding and clamping woodworking workpieces, improvement of existing devices and systems is desirable because of the drawbacks identified above and the benefits associated with the present invention that will become apparent from the drawings and the following description and claims.

SUMMARY OF THE INVENTION

Bench and Other System Elements Generally

The woodworking bench and associated apparatus of the present invention provides an integrated system of bench features, vises, dogs, clamps and fixtures that cooperate to provide a highly flexible workpiece holding and clamping apparatus able to accommodate a wide variety of shapes and sizes of workpieces and hold such workpieces in an enormous variety of positions during numerous different operations. The entire periphery of the workbench is useful and useable, and a central longitudinal depression or trough provides convenient temporary tool storage and central access to workpieces that span the bench top. Round bench dog holes in a rectilinear pattern in the bench top with specific spacing between holes, and similar holes in the edge of the top, facilitate great flexibility in clamping using conventional round dogs in the bench top dog holes and corresponding dogs in bench edge-mounted vises. Such holes also accommodate other clamping, fixing and hold-down fixtures that are a part of the system of the present invention and contribute to its flexibility and utility. These include a twin screw vise, a bench hold-down, a clamping bench dog and a panel clamping fixture.

Two substantial slabs, typically thick hardwood plywood, provide the bench top surface and carry a rectilinear pattern (in rows and files) of round, vertical bench dog holes. The two slabs are separated by a tool trough, and optional bench top ends or caps span the ends of the slabs, unify the bench top structure and provide a fixed jaw for an end-mounted twin screw vise. Optional skirts form a deep longitudinal edge for the top and join the ends to form a rectangular frame for the top.

Dog holes in the edge of the top permit workpieces to be fixed along the bench edge using the hold-down, two clamping bench dogs, or a fixed dog and either of the clamping bench dog or a fixed dog in the end of the twin screw vise. Because of the ability of the bench system of the present invention to hold a workpiece on the bench top and simultaneously hold another workpiece on the edge of the bench top, it is possible easily to accomplish frequently practiced operations that are typically difficult. For instance, two adjacent sides of a blanket chest may be held, one lying against the bench top and the other lying against the bench edge, with one side overlapping the end of the other so that the positions of dovetail pins may be transferred to the chest side that is to have tails (or the reverse among those who cut tails first and from them mark the pins).

Twin Screw Vise

The twin screw vise of the present invention utilizes two threaded vise screw rods that are journaled through flanged nuts fixed to the workbench top or to a rear, fixed bench jaw. The vise screws pass through a movable front jaw, typically made of wood, and into tee-castings and handles that may be turned to rotate the screws. Sprockets are located on each screw between the tee castings and the front jaw and are coupled by a chain. One of the sprockets is fixed in position on its screw during a calibration procedure. The other sprocket remains free to rotate on its screw, except when a spring loaded pin in the corresponding tee-casting engages a depression in the face of the sprocket, thereby coupling that sprocket to the tee casting and associated screw.

Calibration of the vise is achieved by positioning the front jaw parallel to the rear one, typically by fully closing the vise while the normally fixed sprocket is permitted to rotate on its screw and the spring loaded pin engages the free wheeling sprocket. Set screws are then tightened in the fixed sprocket to lock it in position on its screw. Rotation of either handle will then cause both screws to rotate in synchronism so that the front jaw will move in and out parallel to the rear one. If skewing is desired, the spring loaded pin may be held in a retracted position while its associated handle is rotated and then released, which will permit the screw bearing the free wheeling sprocket to rotate independent of the sprocket (and therefore independent of the other screw) for up to one rotation, at which point the spring loading pin will re-engage the sprocket, thereby locking the two screws to rotate in synchronism, unless the pin is again retracted. The automatic re-engagement of the pin both serves to remind the vise user that the two screws have been decoupled and automatically recouples them before the vise skews so severely that damage to its mechanism is risked. The jaw can easily be returned to a parallel relationship simply by disengaging the spring loaded pin and rotating the associated handle in the opposite direction (and repeating the disengagement and rotation if necessary) until the pin reengages with the jaws parallel. Because of the positive location properties of the chain and sprocket and spring loaded pin mechanisms of the present invention, "recalibration" so that the jaws are exactly parallel can be easily and accurately accomplished without the need to fully close the vise.

Bench Hold-Down

The hold-down of the present invention utilizes a round, interchangeable post having annular barb-like ridges that engage the workbench top through round holes that may be located at any positions in the bench top where it is desired to use the hold-down. The post threads into a hold-down body having, on one side of the post, a yoke within which a hold-down arm pivots on a pin received in yoke arms or forks and, on the other side of the post, a screw pressure point and T-shaped slot for receiving the head of a clamping adjustment screw that is journaled through one end of the clamping arm. The other end of the clamping arm, which has a gooseneck shape, terminates in a foot with a rounded pad for exerting pressure against a workpiece.

Clamping Bench Dog

The clamping bench dog of the present invention provides a simple, economical clamp that may typically be used with conventional round dogs but is also usable with square or rectangular dogs, other clamping dogs and the hold-down described above. A section of round metal rod provides a clamp body or post that fits into a bench dog hole. A second, threaded rod passes through a threaded hole near the upper end of the post at an angle of approximately 87° to the axis of the post. A rotatable foot is attached to one end of the threaded rod and can tilt up to about 3°. A handle, knob or tangent on the other end of the threaded rod is utilized to rotate it, and a wire spring journaled in a longitudinal groove on the post assures that the post will remain fixed in bench top dog holes by pressing against the wall of the hole to increase the friction between the post and wall.

Panel Clamping Fixture

The panel clamping fixture of the present invention utilizes two rails, or one rail and the bench top, to capture a panel between a fixed jaw and a clamping jaw. The fixed jaw has a pad positioned on a fixed post positioned between the rails (or rail and bench top), and the clamping jaw has a pad on one end of a clamping screw that is journaled through a clamping jaw post, also positioned between the rails or rail and bench top. Friction-increasing structures on the posts such as barb-shaped or conventional threads or annular rings or knurling resist withdrawal of the posts from the rails (or bench top), thereby effectively maintaining the rails (or bench top) in contact with the face of a panel being clamped within the fixture. This encourages the panel members to remain in alignment during clamping by resisting any tendency such members may have to slip relative to each other perpendicular to the faces of the rails or bench top.

Each of the rails has a series of matching holes located at intervals less than the travel of the clamping screw, so that a panel of any width (within the capacity of the rails) may be accommodated.

BRIEF DESCRIPTION OF THE DRAWINGS

FIG. 6 is a side elevation view of the hold-down depicted in FIG. 1 shown positioned clamping a workpiece to a bench top.

FIG. 7 is a perspective view of the hold-down shown in FIG. 6 with a portion of the post shown broken away.

FIG. 8 is an enlarged view of the post of the hold-down taken at circle 8 in FIG. 6.

FIG. 9 is a perspective view of the clamping bench dog shown in FIG. 1.

FIG. 10 is a side elevation view of the clamping bench dog shown in FIG. 9 with an alternative tangent for rotating the screw.

FIG. 11 is a side elevation view of an alternative embodiment of the panel clamping fixture of the present invention depicted in FIG. 1 using two matching rails and shown clamping four boards edge-to-edge.

DETAILED DESCRIPTION OF THE DRAWINGS

Figure 1:
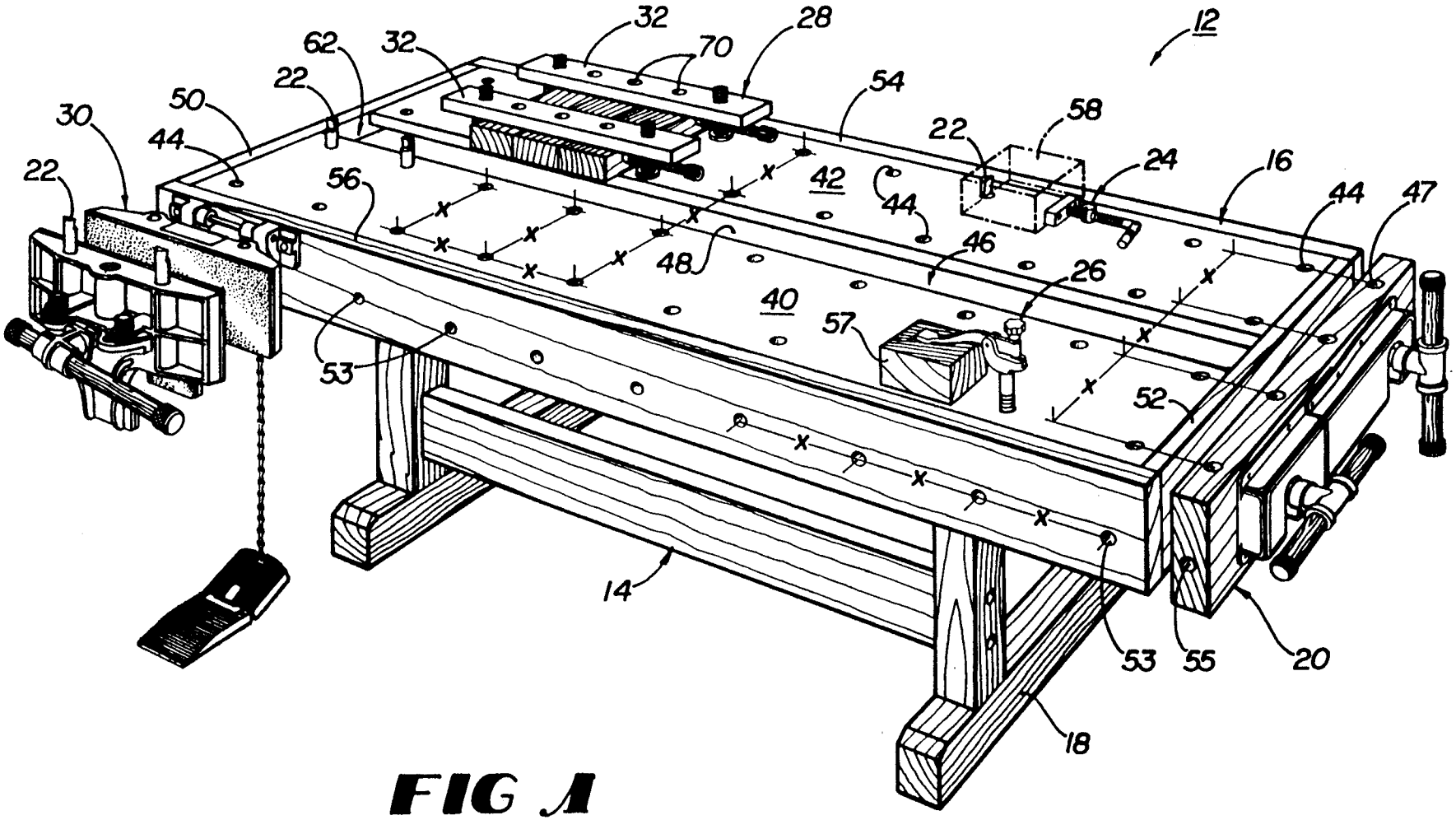
FIG. 1 is a perspective view of the woodworking bench system of the present invention showing the bench, fixed dogs, clamping bench dog, adjustable hold-down, twin screw vise, and edge clamping fixture of the system of the present invention.

The woodworking bench system 12 of the present invention comprises generally a bench 14 having a top 16 that rests on a trestle 18, a twin screw vise 20, bench dogs 22, a clamping bench dog 24, a hold-down 26 and panel clamping fixtures 28. It is illustrated with an adjustable vise 30.

Bench

Bench top 16 may be constructed in a variety of configurations, but optimal flexibility and utility will be achieved if a structure is chosen incorporating the advantageous features of the preferred embodiment illustrated in the figures. In the preferred embodiment of bench top 16, two top members or slabs 40 and 42 provide the principal bench surface, carry a rectilinear pattern of vertically-oriented dog holes 44 and substantially contribute to the strength and stability of bench 14. Slabs 40 and 42 may be made from a variety of natural, manmade or composite materials, including solid hardwood lumber such as maple, beech or cherry. However, hardwood plywood can provide desirable mass, stability, strength and durability for slabs 40 and 42. In particular, by using plywood for slabs 40 and 42 with orthogonally orientated alternating plywood layers, clamping pressure can be exerted across the bench top 16 as well as along its length without the risk of delamination or splitting associated with use of solid lumber or side-by-side laminations of lumber as is more conventional in work bench tops. Plywood also can provide stability unavailable with solid lumber slabs in geographic areas that experience wide excursions in humidity from season to season.

Slabs 40 and 42 are separated by a central depression or trough 46 that may be conveniently formed by suspending a suitable bottom 48 (made of solid lumber, plywood or other appropriate material) from and between the undersides of slabs 40 and 42. Optional bench top ends 50 and 52 provide support for the ends of slabs 40 and 42, and end 52 also serves as a fixed jaw for twin screw vise 20. Optional skirts 54 and 56 form a deep longitudinal edge for bench top 16 and, together with ends 50 and 52, complete a rectilinear frame unifying bench top 16 as a rigid structure. By stopping bottom 48 short of end 50, an opening 62 is provided through which shavings or other debris accumulated in trough 46 may be swept.

Bench dog holes 44 are formed in bench top 16 along axes orthogonal to the surface of top 16, so that two parallel rows or ranks of paired holes 44 occur along each of slabs 40 and 42, and parallel files of four equally spaced holes 44 occur across top 16. By locating holes 44 in such a rectilinear matrix with each hole 44 equally distant from each adjacent hole 44, a desirable clamping matrix can be achieved, particularly when dogs or dog holes in vises mounted on the bench also are aligned with ranks or files of holes 44, such as dogs 22 in adjustable vise 30 and dog holes 47 in twin screw vise 20. While any appropriate center-to-center distance between holes 44 may be used, a desirable interval is seven and one-half inches (7½"), and dogs and dog holes nominally three quarters of an inch (¾") in diameter function very well. As may be seen in FIG. 1, each rank or row of holes 44 in bench top 16 is aligned with a dog hole 47 in the top of moveable jaw 124 of twin screw vise 20 that is mounted against bench top end 52. As will be understood by one of ordinary skill in the art, the described and illustrated location of holes 44 in top 16 also permits alternative location of twin screw vise 20 on the front skirt 56 or rear skirt 54 of bench 14, with alignment between holes 47 in moveable jaw 124 of twin screw vise 20 and corresponding files of holes 44 in bench top 16. Alternatively or additionally, an adjustable vise such as the Veritas® Tucker Vise 30 (disclosed in U.S. Pat. No. 5,127,639) also having bench dogs located on the same center-to-center distance can be mounted on either skirt 54 or 56 or on end 50 or 52 of the top 16.

Bench dog holes 53 may be located in each skirt 54 and 56 to permit clamping of workpieces against the vertical edge of top 16 formed by skirts 54 and 56. Location of a dog hole 55 in the end of moveable jaw 124 of twin screw vise 20 permits clamping between bench dogs in each of jaw hole 55 and one of skirt holes 53. Alternatively, when skirts are omitted, dog holes 53 may be formed in whatever structure forms the edge of top 16, such as the edges of slabs 40 and 42.

The hold-down 26 of the present invention may be located in virtually any of dog holes 44, 47, 53 or 55 and utilized as described below to fix a workpiece 57 in position.

Alternatively, a workpiece 58 may be fixed between a bench dog 22 and clamping bench dog 24, as is illustrated on slab 42 of workbench top 16 in FIG. 1.

By the use of clamping rails 32 having holes 70 located at intervals so that at least some of such holes 70 match the location of holes 44 in workbench top 16, it is possible to utilize top 16 as one side of a panel clamping fixture 28, as is also illustrated in position on slab 42 of top 16.

Twin Screw Vise

Figure 2:
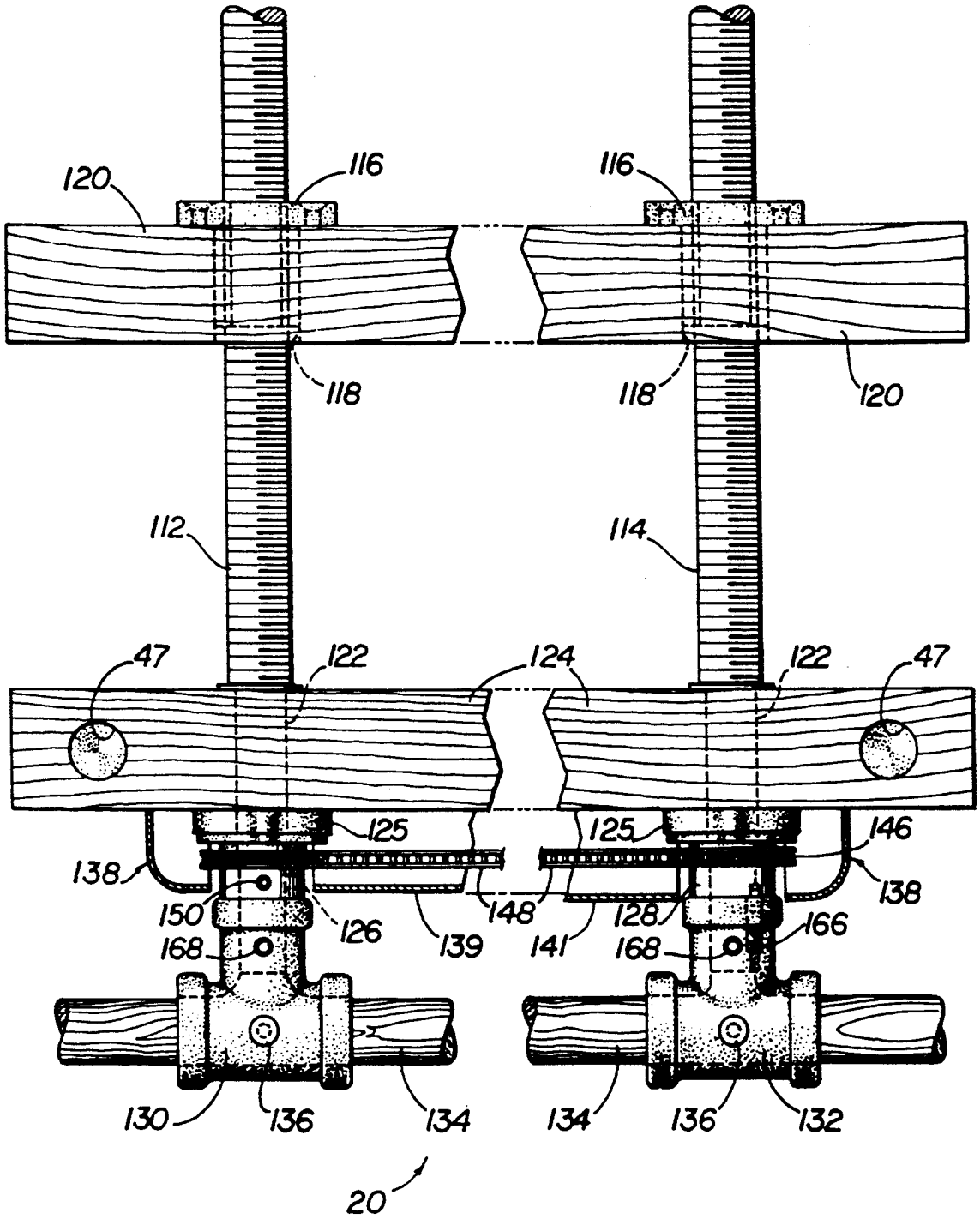
FIG. 2 is a top plan view of the twin screw vise depicted in FIG. 1 showing a central portion of the vise jaws, chain and cover cut away.
Figure 3:
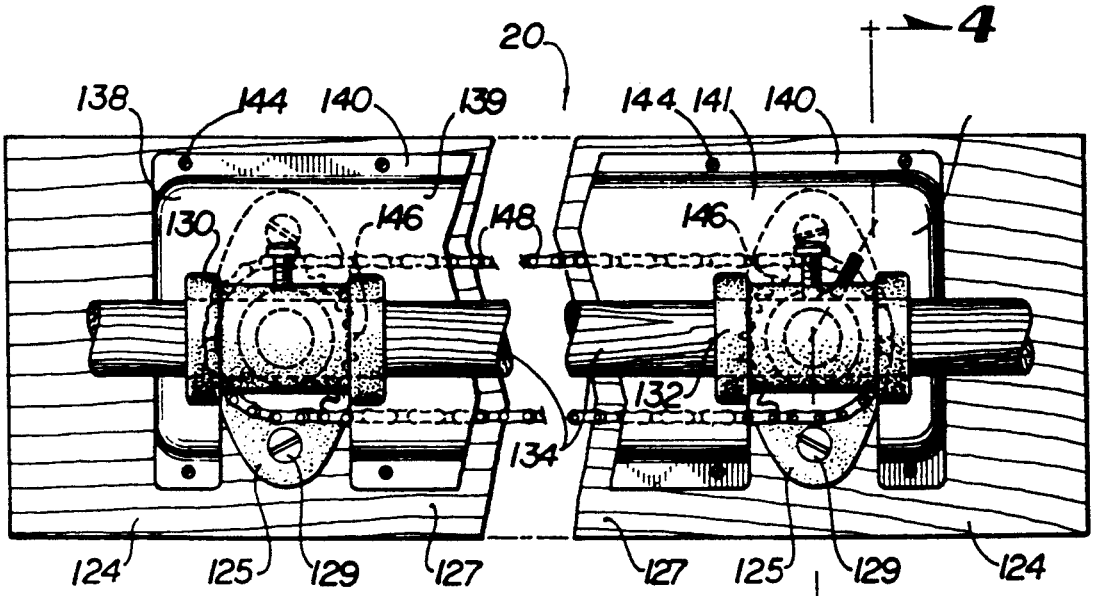
FIG. 3 is a front elevation view of the twin screw vise shown in FIG. 2, again showing central portions of the structure and the handles cut away for clarity.
Figure 4:
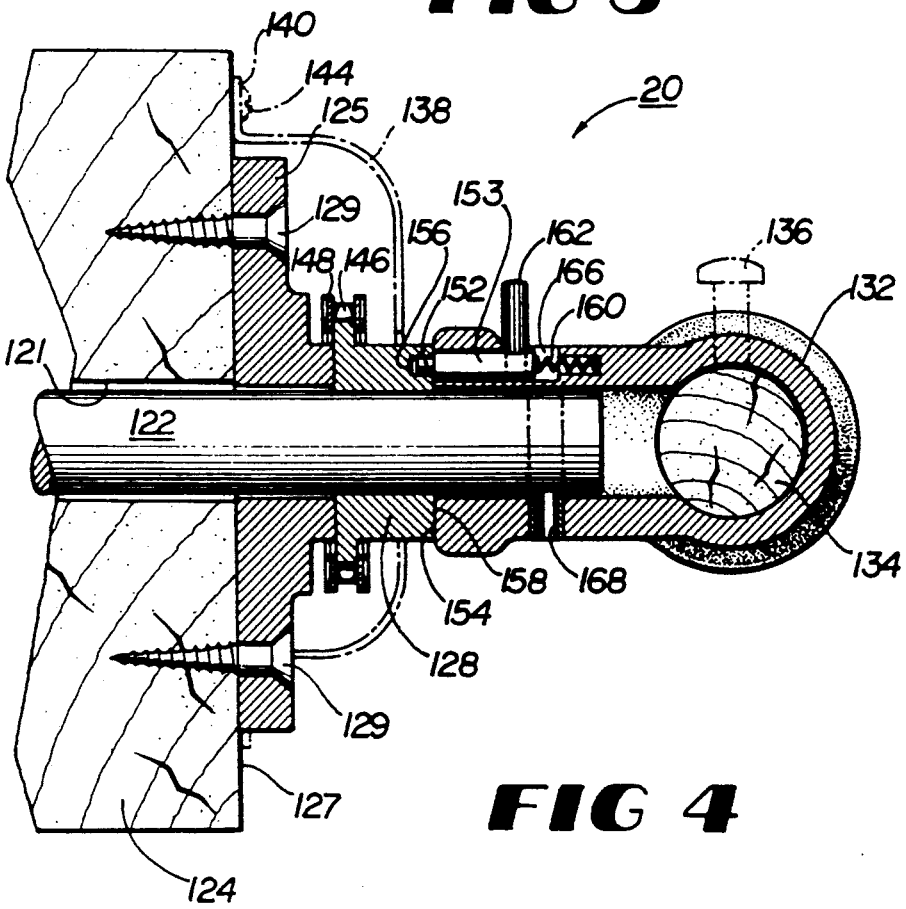
FIG. 4 is a section view through the disengageable screw of the twin screw vise shown in FIG. 2 taken along line 44 in FIG. 3.
Figure 5:
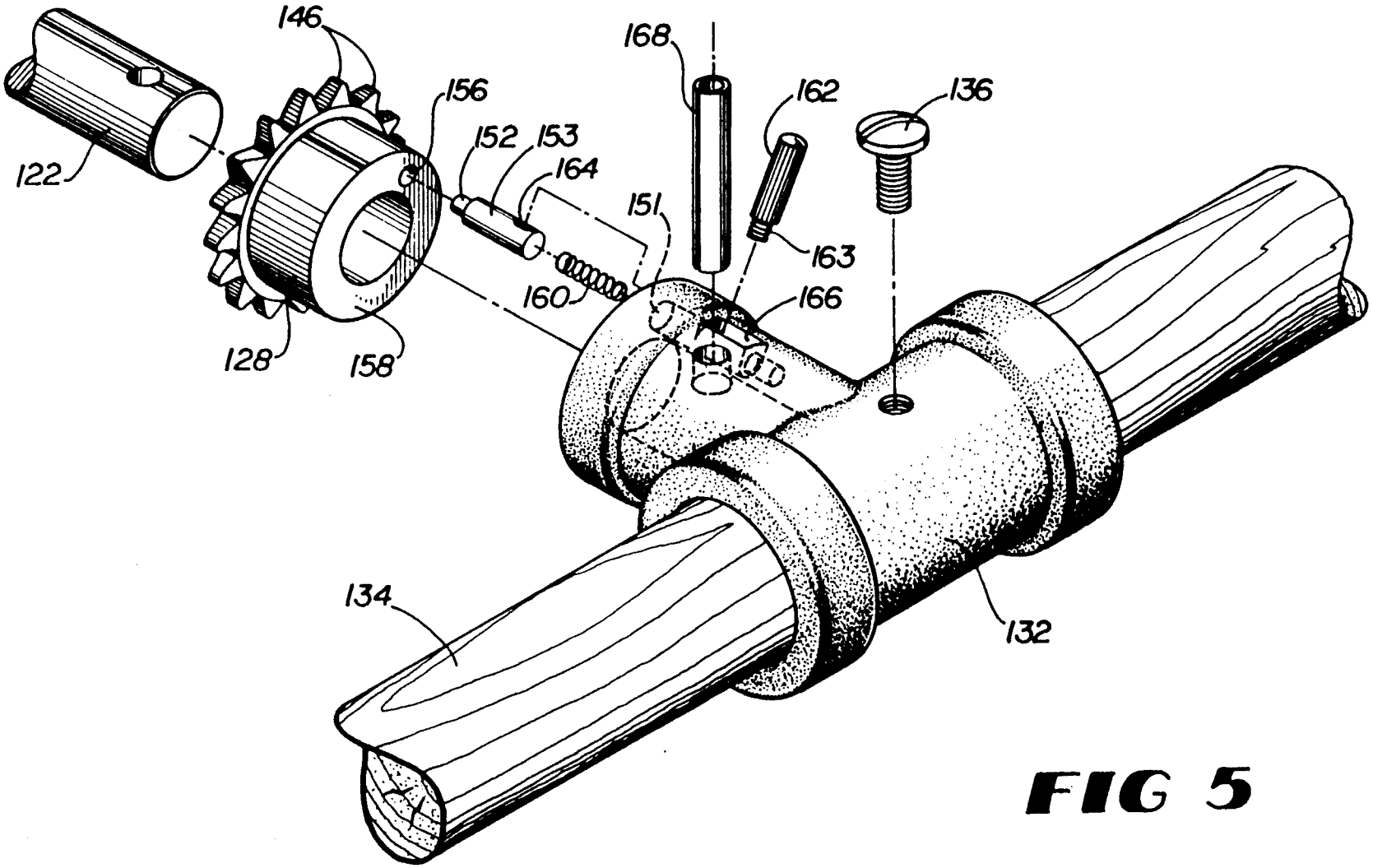
FIG. 5 is an exploded perspective view of the disengageable handle and sprocket mechanism that is shown in section in FIG. 4.

The twin screw vise 20 of the present invention, illustrated in detail in FIGS. 2–5, comprises generally two vise screws 112 and 114 that are appropriately threaded along most of their length and pass through flanged nuts 116 that are positioned in holes 118 in, and are affixed to, rear or fixed vise jaw 120 (end 52 in FIG. 1 serves as fixed vise jaw 120). The front end portions 122 of vise screws 112 and 114 preferably are not threaded and pass through holes 121 in front or movable jaw 124, thrust plates 125, sprockets 126 and 128 and into tee fixture 130 or 132. As is best shown in FIGS. 3 and 4, thrust plates 125 are affixed to the front 127 of movable jaw 124 with screws 129 or other appropriate means. An appropriate handle 134 slides within each tee fixture 130 and 132 perpendicular to the longitudinal axes of screws 112 and 114. Each handle 134 may be fixed within its respective tee fixture 130 or 132 by tightening a threaded locking screw 136 that passes through the tee fixture 130 or 132 and may bear against the handle 134. Each tee fixture 130 and 132 is fixed on the end of its respective screw 112 or 114 with set screws, a rolled pin 168 or other appropriate means.

A plastic or metal dust cover 138 shown in section in FIGS. 2 and 4 and in elevation in FIG. 3, and having a flange 140, may be fixed to the front 127 of moveable jaw 124 with wood screws 144 or by other appropriate means. The dust cover 138 may be a single piece where the desired spacing between screws 112 and 114 is known. Alternatively, as illustrated in FIG. 2, one side 139 of cover 138 may be slightly larger than the other side 141 of cover 138 so that the two sides 139 and 141 can overlap in a nesting relationship and thus telescope to accommodate different spacings between screws 112 and 114.

Each sprocket 126 and 128 has teeth 146 that engage a roller chain 148 that links the two sprockets so they always rotate in synchronism. Fixed sprocket 126 is locked on screw 112 with one or more set screws 150 that are threaded into sprocket 126 and may be tightened against vise screw 112. Rotatable sprocket 128 does not utilize set screws and may therefore freely rotate on vise screw 114 except when coupled to tee fixture 132 by a pin 152 (visible in FIGS. 2, 4 and 5) on the end of a plunger 153 that slides within a bore 151 in the sprocket bearing face 154 of tee fixture 132 so that pin 152 can protrude from face 154 of tee fixture 132 and be received within a depression 156 bored or otherwise formed in the face 158 of sprocket 128. Plunger 153 is urged toward sprocket 128 by a spring 160 but may be draw into tee fixture 132 and against spring 160 in order to disengage pin 152 from depression 156 by applying pressure to a plunger lever 162. Lever 162 may be a short length of rod with a threaded end 163 received in a threaded bore 164 in and oriented perpendicular to the longitudinal axis of plunger 153. Lever 162 protrudes through a slot 166 that communicates with bore 151 in tee fixture 132.

As noted above, twin screw vise 20 may be "calibrated" by rotating the handles 134 to turn both vise screws 112 and 114 until moveable jaw 124 is fully closed against fixed jaw 120 while sprocket 126 is not locked on screw 112. After the jaws 120 and 124 ar® fully closed, and with pin 152 seated in depression 156, set screw 150 is utilized to lock fixed sprocket 126 in place on screw 112. Rotation of either handle 134 will then cause both screws 112 and 114 to rotate in synchronism and moveable jaw 124 to move in and out parallel to jaw 120, unless plunger lever 162 is manipulated to disengage pin 152 from the depression 156 in face 158 of sprocket 128.

The addition of additional depressions 156 in the face 158 of sprocket 128 will allow re-engagement of sprocket 128 and tee fixture 132 after less than one full rotation of tee fixture 132 and screw 114 if it is desired that skewed coupling of the screws 112 and 114 be possible at smaller than one full rotation intervals. Among other substitutions, a vee or other type of belt, chain or coupling could be substituted for roller chain 148.

It will similarly be appreciated that skewing of movable jaw 127 causes screws 112 and 114 to move out of the parallel relationship they assume in the absence of such skewing, thereby limiting the skewing possible without damages to vise 20 and that the amount of skewing possible will be partially a function of (a) the distance jaws 120 and 124 are open, (b) the tolerance between flanged nuts 116 and screws 112 and 114, (c) the diameter of the holes 121 in jaw 124 (see FIG. 3) relative to the diameter of end portions 122 of screws 112 and 114. Accordingly, adjustment of these parameters, among others, will affect the operating characteristics of vise 20, including the amount of skewing possible.

Hold-Down

The hold-down 26 of the present invention, shown holding a workpiece 57 in FIG. 1 and illustrated in detail in FIGS. 6–8, includes a post 212 threaded into a hold-down body 214 that forms a yoke 216 within which hold-down arm 218 pivots on a pin 220 that passes through the forks 222 of yoke 216. Gooseneck shaped arm 218 terminates in a foot 224 having a rounded pad 226 that bears against the workpiece 57. The opposite or clamping screw end 230 of arm 218 is bored and threaded to receive clamping screw 232 that is rotated by a knob 234 fixed on one end of screw 232 with set screw 236. Clamping screw 232 terminates opposite knob 234 with a rounded-over head 238 that bears against the bearing surface 240 of body 214, which is located on the other side of post 212 from the pivot point of arm 218 on pin 220 in yoke 216. Bearing surface 240 is the bottom of a T-shaped slot 242 in body 214 within which head 238 of screw 232 is received and retained so that pivoting of arm 218 on pin 220 is limited even when pad 226 of foot 224 is not bearing against a workpiece 57.

As may be seen best in FIG. 8, post 212 is formed with a sloping thread 244 which leave barb-like projections 246 around post 212 that resist its withdrawal from the hole 248 in bench top 250 (that may, for instance, be one of slabs 40 or 42 or skirt 54 or 56 in FIG. 1) Such barb-like projections 246 substantially enhance the stability of post 212 within hole 248, and prevent withdrawal of post 212 from hole 248 when knob 234 is rotated to cause head 238 of screw 232 to bear against bearing surface 240 of body 214, thereby causing arm 218 to pivot down and apply pressure to workpiece 57 through pad 226 on foot 224. Friction-increasing structures alternative to such a barb-shaped thread may also be used on post 212. For instance, post 212 may be knurled, or ridges, annular projections, other types of threads or other shapes may be formed on its surface to increase friction between post 212 and the sides of hole 248 in top 250.

Because post 212 is attached to body 214 by threads 252 on the end of post 212 and within the post-receiving hole 254 of body 214, post 212 may be easily removed from body 214 for the purpose of substituting a similar post of greater length to permit use of hold-down 26 to fix workpieces of greater size to a bench top.

As will be readily understood by those skilled in the art, the hold-down 26 of the present invention overcomes the shortcomings of previously known hold-down fixtures and can be very easily and conveniently used. Hold-down 26 may be used to secure a workpiece by inserting post 212 in a hole 248 in a workbench top 250 and pressing the entire hold-down 26 toward the workpiece until pad 226 contacts it, which will cause post 212 to cant within hole 248 and lightly clamp workpiece 57 in place. Rotation of knob 234 will then apply additional pressure to workpiece 57 as arm 218 is thereby caused to pivot. The ability to achieve initial clamping pressure without rotating knob 234 that is provided by hold-down 26, particularly because of the barb-like projections 246 on post 212, is especially useful when clamping workpieces vertically against the side of a workbench (such as skirt 56 of bench 14), as is typically done, for instance, when shooting the edge of a long board with a hand plane.

Clamping Bench Dog

The clamping bench dog 24 of the present invention shown holding a workpiece 58 against a fixed dog 22 in FIG. 1 is illustrated in perspective in FIG. 9 and in elevation in FIG. 10. Clamping bench dog 24 comprises a round post 310 through which a screw 312 is journaled in a threaded hole 314 penetrating the upper end 316 of post 310. Screw 312 may be rotated utilizing a tangent 318 that may be a flat section of plate fixed to pivot in a slot in the end of screw 312 on a pin 320 as illustrated in FIG. 10. Alternatively, and preferable, tangent 318 is formed of a short section of round rod and is attached to pivot on pin 320 that passes through one end 322 of rod 312 transverse to its major axis. Tangent 318 desirably carries knurling so that it may be easily spun between the user's thumb and forefinger when it is oriented along the major axis of screw 312 in order to rapidly rotate screw 312. Alternatively, by pivoting tangent 318 at right angles to screw 312, it may be used as a moment arm that facilitates exertion of substantial force to rotate screw 312. Clamping pad 324, which may typically be a short rectangular section of brass, steel or other appropriate material, is attached to the end 326 of screw 312 opposite tangent 318. Such attachment may be accomplished by a variety of conventional methods. In the method illustrated in FIGS. 9 and 10, end 326 of screw 312 is turned to a reduced diameter so that a shoulder 325 is formed, and an annular depression is formed near the end 326 to receive a split clamping ring 328 that seats within a recess 330 in the face 332 of pad 324, which recess 330 may be a blind bore coaxial with and larger in diameter than hole 346. Holes 334 in pad 324 facilitate the attachment to pad 324 of auxiliary (typically wood) jaws in a wide variety of shapes to facilitate use of clamping bench dog 24 in holding irregularly shaped objects and to protect such objects from damage resulting from direct contact with pad 324. For instance, a vee-shaped auxiliary face may be attached to pad 324 in order to clamp a round object.

Clamping pad 324 should be of sufficient width that a force exerted on the workpiece 52 parallel to the bench top 16 and perpendicular to screw 312 will not easily cause clamping dog 24 to pivot or rotate, despite the limited "play" between clamping pad 324 and screw 312 described below.

The surface of post 310 is typically smooth, but a longitudinal groove 336 positioned at 90° from the axis of screw 312 receives a wire spring 338, one end of which 340 will typically be swaged in the groove 336 as shown at 342. The other end 344 of spring 338 remains free to slide in groove 336 as spring 338 is compressed against post 310 when post 310 is inserted in a hole 44 in bench 12. It is important that the axis of hole 314, and therefore the longitudinal axis of screw 312 when it is journaled in threaded hole 314, not be at 90° to the longitudinal axis of post 310. Instead, by locating the axis of hole 314 a few degrees off of ninety degrees (90°) (at, for instance, eighty-seven degrees (87°)), screw 312 may be inserted through post 310 so that the pad end 326 of screw 312 is slightly closer to bench top 16 during use than the tangent end 322 of screw 312, with the result that pad 324 exerts pressure against workpiece 58 that includes a vector normal to bench top 16, thereby tending to force workpiece 58 not only against dog 22 but against bench top 16 as well. Such downward inclination of screw 312 also compensates for the inevitable canting of post 310 within hole 44 when pressure is exerted on the workpiece 58, thereby reducing the possibility that such pressure will include a vector away from the bench top 16 and that the workpiece 57 will be lifted from contact with bench top 16.

In order to facilitate seating of pad 324 squarely against workpiece 57 even though screw 312 may be slightly canted relative to the workpiece 57 or the workpiece 58 itself may have an inclined face, it is desirable for pad 324 to "wobble" a few degrees on the end of screw 312, such as approximately three degrees (3°), as illustrated in FIG. 10. This may be easily accomplished simply by making the reduced diameter end 326 of screw 312 sufficiently smaller than the hole 346 in pad 324 through which it passes to result in appropriate "play" between pad 324 and the end 326 of screw 312.

Panel Clamping Fixture

Panel clamping fixture 28 is illustrated in FIG. 1 utilizing rails 32 and bench top 16 and in FIG. 11 utilizing two substantially identical rails 32. As is illustrated in FIG. 11, panel 424 to be clamped is captured between a fixed jaw pad 410 journaled on fixed post 412 and a clamping jaw pad 414 on one end of a clamping screw 416 that has a head 418 and is journaled through a clamping jaw post 420 that also carries a clamping jaw nut 422. As will be readily understood by reference to FIGS. 1 and 11, clamping fixture rails 32 may be made of any convenient length adequate to span the widest anticipated panels 424 (consisting of boards or panel members 426 that are to be joined). Each of rails 32 has a series of matching holes located at intervals less than the travel of clamping screw 416 in clamping jaw post 420, so that a panel 424 of any width (within the capacity of rails 32) may be clamped between fixed jaw pad and clamping jaw pad 414 by appropriate location of fixed post 412 within rails 32 and rotation of screw 418. As noted above, selection of locations for holes 70 in rails 32 so that at least some of holes 70 match the holes 44 in bench top 16 permits bench top 16 to be used in panel clamping as illustrated in FIG. 1.

Each of posts 412 and 420 are sections of round rod and may be threaded along their entire length in order to receive the fixed jaw pad 410 (in the case of fixed post 412) or positioning nuts as an alternative to O-ring 422. Such threading along at least the portions received in holes 70 in rails 32 also reduces the tendency of the post 412 and 420 to slip within holes 70 in rails 32. Preferably, opposed barb-shaped threads like the one illustrated in FIG. 8 are formed on each end of posts 412 and 420. Such threads offer substantial resistance to withdrawal of each end of posts 412 and 420 from rails 32. Each of posts 412 and 420 may be made of a Variety of materials, although an appropriate grade of steel is likely to provide the desired combination of strength and economy. Pads 410 and 414 may also be made of steel, but fabrication of these parts in brass is an attractive alternative. Pad 410 can be a square nut that is threaded onto post 412, if an appropriate thread is used, or held in place with a set screw 413 if it is not, and other shapes and methods of fixation on post 412 may also be utilized so long as a surface of appropriate size and shape is provided for contact with panel 424. An elastic rubber or neoprene O-ring 422 facilitates positioning post 420 or 412 within the holes 70 in rails 32 by limiting penetration of the post into hole 70. Alternatively, a square, hexagonal or round (knurled or plain) nut threaded onto post 412 or 420 can be substituted for O-ring 422.

Clamping jaw pad 414 must be fixed to the end of screw 416 so that the screw may rotate while pad 414 remains fixed relative to panel 424. This may be accomplished in a number of conventional manners including turning the end of screw 416 to form a shoulder adjacent to an end section of reduced diameter, smooth rod having an annular depression to receive a split locking ring after the reduced diameter rod is inserted through a hole in pad 414 and the clamping ring is received in a larger diameter bore in the opposite face of pad 414. Precisely such an arrangement is illustrated in FIG. 9 where it is used to affix pad 324 to the end of 312 of clamping bench dog 24.

The head 418 of screw 416 may be knurled to permit rotation of screw 416 with the user's fingers. Additionally, a hexagonal recess in head 418 permits more forceful rotation of screw 416 utilizing a hex or "Allen" wrench.

While only two clamping fixtures 28 are illustrated in FIG. 1, and only one is visible in FIG. 10, as will be readily understood by one skilled in the art, any number of clamping fixtures 28 may be utilized in gluing a panel 424 in order to exert pressure at appropriate intervals along its edges.

The foregoing description of this invention is for the purposes of explanation and illustration. It will be apparent to those skilled in the art that modification and changes may be made to this invention without departing from the scope and spirit of the preceding description and the following claims.

We claim:

1. An apparatus for holding woodworking workpieces, comprising:

(1) a woodworking bench comprising two bench slabs forming a bench top and separated by a tool trough, each of which slabs has round dog holes penetrating the top and arranged in at least two parallel rows spanning the length of the slab and forming files of holes across the bench top, each of which holes is equally distant from each immediately adjacent hole and wherein the bench top has front and back edges and two ends and a row of round dog holes along at least one of the edges of the top, and (2) a twin screw vise mounted on one of the ends of the bench and having a moveable jaw having:

a. a top and tow ends, b. a width substantially equal to the width of the bench, c. one dog hole in the top of the jaw corresponding to each row of holes in the bench top and d. a dog hole in one of the ends of the jaw corresponding to the row of holes in the bench edge.

2. An apparatus for holding woodworking workpieces, comprising:

(1) a woodworking bench comprising two bench slabs forming a bench top and separated by a tool trough, each of which slabs has round dog holes penetrating the top and arranged in at least two parallel rows spanning the length of the slab and forming files of holes across the bench top, each of which holes is equally distant from each immediately adjacent hole and wherein the bench top has front and back edges and two ends and a row of round dog holes along at least one of the edges of the top, and (2) a twin screw vise, comprising:

(a) two vice screws positioned to move (b) a vise jaw relative to the bench top, (c) a first sprocket journaled on and fixable to one of the vise screws, (d) a second sprocket journaled to freely rotate on the other vise screw, (e) a means for coupling the second sprocket to the other vise screw in at least one predetermined rotational position, and (f) a chain coupling the two sprockets so they will rotate in synchronism.

3. An apparatus for holding woodworking workpieces, comprising:

(1) a woodworking bench comprising two bench slabs forming a bench top and separated by a tool trough, each of which slabs has round dog holes penetrating the top and arrange din at least two parallel rows spanning the length of the slab and forming files of holes across the bench top, each of which holes is equally distant from each immediately adjacent hole, (2) a twin screw vise, comprising:

(a) two vice screws positioned to move (b) a vise jaw relative to the bench top, (c) a first sprocket journaled on and fixable to one of the vise screws, (d) a second sprocket journaled to freely rotate on the other vise screw, (e) a means for coupling the second sprocket to the other vise screw in at least one predetermined rotational position (f) a chain coupling the two sprockets so they will rotate in synchronism, and (g) two tee-fixtures, one of which is secured to each vise screw adjacent to the sprocket journaled on the respective vise screw and wherein the means for coupling comprises a spring-loaded, retractable pin positioned in and protruding from one of (i) the second sprocket or (ii) the tee fixture secured to the other vise screw so that the pin may be received within a depression in the other of (i) the second sprocket or (ii) the tee fixture secured to the other vise screw when the pin is not retracted.

4. The apparatus of claim 3, further comprising:

(h) two thrust plates, one of which is journaled on each of the vise screws, (i) a dust cover affixed to the vise jaw and substantially surrounding the chain, (j) two handles, one of which is positioned within each tee fixture in order to facilitate rotation of the tee fixture, and (k) a means for fixing each handle to the tee fixture within which it is positioned.

5. Apparatus for a woodworking bench having a twin screw vise utilizing a movable jaw and a fixed jaw, comprising:

a. two bench top slabs, each of which slabs has round dog holes penetrating the slab and arranged in two parallel rows of equally spaced holes spanning the length of the slab, b. two vise screw assemblies, each comprising:

(i) a vise screw attached to (ii) a tee fixture, (iii) a sprocket journalable on the vise screw, (iv) a thrust plate journalable on the vise screw for attachment to the movable jaw, and (v) a flanged nut for receiving the vise screw and attachment to the fixed jaw, c. at least one set screw threaded into one of the sprockets for fixing that sprocket on one of the vise screws, d. a means for intermittently coupling the other sprocket to the other vise screw comprising a spring-loaded, retractable pin positioned in and protruding from one of (i) the other sprocket or (ii) the tee fixture fixed to the other vise screw to be received within a depression in the other of (i) the other sprocket or (ii) the tee fixture fixed to the other vise screw when the pin is not retracted, and e. a chain for coupling the two sprockets.

6. The apparatus of claim 5, further comprising:

f. a handle positionable in each of the tee fixtures, g. a means for fixing the handles in each of the tee fixtures, and h. a dust cover affixable to the movable jaw for substantially surrounding the chain when it is positioned to couple the sprockets.

7. An apparatus for holding woodworking workpieces, comprising:

(a) a woodworking bench comprising two bench slabs forming a bench top and separated by a tool trough, each of which slabs has round dog holes penetrating the top and arranged in at least two parallel rows spanning the length of the slab and forming files of holes across the bench top, each of which holes is equally distant from each immediately adjacent hole, (b) at least one bench dog inserted in one of the dog holes, and (c) at least one clamping bench dog inserted in the another of the holes for clamping a workpiece against the bench dog, the clamping bench dog comprising:

i. a post having two end sand a threaded bore near one of the ends of the post,
ii. a screw having two ends and journaled in the threaded bore,
iii. a pad rotatably fixed on one of the ends of the screw,
iv. means on the other end of the screw for rotating the screw, and
v. means for increasing friction between the post and a dog hole within which it is positioned.

8. The apparatus of claim 7, wherein the screw rotating means is a handle pivotably attached to the other end of the screw.

9. The apparatus of claim 8, wherein the handle is a section of round rod substantially the same diameter as the screw.

10. The apparatus of claim 7, wherein the post is round and the friction increasing means is a wire spring having two ends, one of which ends is fixed to the post.

11. The apparatus of claim 7, wherein the post has a longitudinal axis and the bore is located on an axis rotated approximately 87° from the post longitudinal axis.

12. The apparatus of claim 11, wherein the pad is tiltably fixed on the end of the screw.

13. An apparatus for holding woodworking workpieces, comprising:
a. at least one slab having at least two dog holes,
b. at least one bench dog inserted in one of the holes,
c. at least one clamping bench dog inserted in the other of the holes for clamping a workpiece against the bench dog comprising:
i. a post having two ends and a threaded bore near one of the ends of the post,
ii. a screw having two ends and journaled in the threaded bore,
iii. a pad rotatably fixed on one of the ends of the screw,
iv. means on the other end of the screw for rotating the screw, and
v. means for increasing friction between the post and the dog hole within which it is positioned, wherein the post is round and the friction increasing means is a wire spring having two ends, one of which ends is fixed to the post.

14. The apparatus of claim 13, wherein the screw rotating means is a handle pivotably attached to the other end of the screw.

15. The apparatus of claim 14, wherein the handle is a section of round rod substantially the same diameter as the screw.

16. The apparatus of claim 13, wherein the post has a longitudinal axis and the bore is located on an axis rotated approximately 87° from the post longitudinal axis.

17. The apparatus of claim 16, wherein the pad is tiltably fixed on the end of the screw.

18. An apparatus for holding woodworking workpieces, comprising:
(1) a woodworking bench comprising two bench slabs forming a bench top and separated by a tool trough, each of which slabs has round dog holes penetrating the top and arranged in at least two parallel rows spanning the length of the slab and forming files of holes across the bench top, each of which holes is equally distant from each immediately adjacent hole, and
(2) a panel clamping fixture, comprising:
a. a clamping rail having at least two holes, each of which matches a hole in the bench,
b. a fixed jaw post having two post ends and a pad centrally located on the fixed post, one of which post ends is received in one of the holes in one of the rail or the bench, and the other of which post ends is received in one of the holes in the other of the rail or the bench, and
c. a clamping jaw assembly comprising a clamping post having two ends and a threaded hole through which a clamping screw is journaled to bear against a clamping pad, one of which clamping post ends is received in another of the holes in the rail or the bench and the other of which clamping post ends is received in the matching hole in the other of the rail or the bench.

19. The apparatus of claim 18, further comprising a means for limiting the extent of penetration of one end of the clamping jaw post into a rail hole.

20. The apparatus of claim 19, wherein the means for limiting penetration is an O-ring positioned on the clamping jaw post.

21. The apparatus of claim 18, further comprising a means for increasing friction between the posts and the rails.

22. The apparatus of claim 21, wherein the friction increasing means comprises a barb-shaped thread formed on the surface of each post.

23. An apparatus for clamping panels, comprising:
a. a woodworking bench comprising two bench slabs forming a bench top and separated by a tool trough, each of which slabs has round dog holes penetrating the top and arranged in at least two parallel rows spanning the length of the slab and forming files of holes across the bench top, each of which holes is equally distant from each immediately adjacent hole,
b. a clamping rail having at least two holes, each of which matches a hole in the bench,
c. a fixed jaw post having two post ends and a pad centrally located on the fixed post, one of which post ends is received in one of the holes in one of the rail or the bench, and the other of which post ends is received in one of the holes in the other of the rail or the bench,
d. a clamping jaw assembly comprising a clamping post having two ends and a threaded hole through which a clamping screw is journaled to bear against a clamping pad, one of which clamping post ends is received in another of the holes in the rail or the bench and the other of which clamping post ends is received in the matching hole in the other of the rail or the bench.

24. The apparatus of claim 23, further comprising a means for limiting the extent of penetration of one end of the clamping jaw post into a rail hole.

25. The apparatus of claim 24, wherein the means for limiting penetration is an O-ring positioned on the clamping jaw post.

26. The apparatus of claim 23, further comprising a means for increasing friction between the posts and the rails.

27. The apparatus of claim 26, wherein the friction increasing means comprises a barb-shaped thread formed on the surface of each post.

28. An apparatus for clamping panels, comprising:
a. a slab penetrated by at least two holes,
b. a clamping rail having at least two holes, each of which matches a hole in the slab, c. a fixed jaw post having two post ends and a pad centrally located on the fixed post, one of which post ends is received in one of the holes in one of the rail or the slab, and the other of which post ends is received in one of the holes in the other of the rail or the slab, d. a clamping jaw assembly comprising a clamping post having two ends and a threaded hole through which a clamping screw is journaled to bear against a clamping pad, one of which clamping post ends is received in another of the holes in the rail or the slab and the other of which clamping post ends is received in the matching hole in the other of the rail or the slab.

29. An apparatus for holding woodworking workpieces, comprising:

(1) a woodworking bench comprising two bench slabs forming a bench top and separated by a tool trough, each of which slabs has round dog holes penetrating the top and arranged in at least two parallel rows spanning the length of the slab and forming files of holes across the bench top, each of which holes is equally distant from each immediately adjacent hole, (2) a hold-down positioned in one of the holes, the hold-down comprising:

(a) a round post having a longitudinal axis, (b) a body fixed to the post, (c) an arm pivotably attached to the body, and (d) means for causing the arm to pivot by exerting pressure on the body at a point removed from the axis of the post, x. wherein the body contains a T-shaped slot and y. the means for exerting pressure comprises a screw threaded into the arm and having a head that is positioned within the slot so that the screw may be rotated to apply pressure through the screw head against the body but substantial movement of the screw head away from the body is resisted by the portions of the body that form the T-shaped slot.

30. An apparatus for holding woodworking workpieces, comprising:

(1) a woodworking bench comprising two bench slabs forming a bench top and separated by a tool trough, each of which slabs has round dog holes penetrating the top and arranged in at least two parallel rows spanning the length of the slab and forming files of holes across the bench top, each of which holes is equally distant from each immediately adjacent hole, and (2) a hold-down positioned in one of the holes, the hold-down comprising:

(a) a round post having annular grooves that form barb-like projections along a portion of the post and threads on one end to be received in (b) a body (i) containing a threaded bore for receiving the threaded end of the post and (ii) forming (x) a yoke comprising two forks positioned on one side of the threaded bore and (y) a bearing surface and a T-shaped slot on the other side of the threaded bore, and (c) a pin that passes through the forks of the yoke and through (d) an arm that pivots on the pin and terminates at one end in a foot having a rounded pad for bearing against a workpiece and contains at its other end a threaded bore within which is journaled (e) a screw having on one end a head that is captured within the T-shaped slot and on its other end (f) a knob for rotating the screw so that the head bears against the bearing surface on the body, thereby causing the arm to pivot as the screw is rotated.

31. A workpiece holding fixture, comprising:

a. a woodworking bench comprising two bench slabs forming a bench top and separated by a tool trough, each of which slabs has round dog holes penetrating the top and arranged in at least two parallel rows spanning the length of the slab and forming files of holes across the bench top, each of which holes is equally distant from each immediately adjacent hole, and b. a hold-down positioned in one of the holes, comprising:

i. a round post having a longitudinal axis, ii. a body fixed to the post, iii. an arm pivotably attached to the body, and iv. means for causing the arm to pivot by exerting pressure on the body at a point removed from the axis of the post, c. wherein the body contains a T-shaped slot and d. the means for exerting pressure comprises a screw threaded into the arm and having a had that is positioned within the slot so that the screw may be rotated to apply pressure through the screw head against the body but substantial movement of the screw head away from the body is resisted by the portions of the body that form the T-shaped slot.

* * * * *